US005604405A

United States Patent [19]

Ogura

[11] Patent Number: 5,604,405

[45] Date of Patent: Feb. 18, 1997

[54] MAGNETRON WITH FEED-THROUGH CAPACITOR HAVING A DIELECTRIC CONSTANT EFFECTING A DECREASE IN ACOUSTIC NOISE

[75] Inventor: Toshio Ogura, Mobara, Japan

[73] Assignees: Hitachi, Ltd., Tokyo; Hitachi Nisshin Electronics Co., Ltd., Chiba-ken, both of Japan

[21] Appl. No.: 272,118

[22] Filed: Jul. 7, 1994

[30] Foreign Application Priority Data

Jul. 7, 1993 [JP] Japan ..... 5-168010

[51] Int. Cl.[6] ..... H01J 23/54

[52] U.S. Cl. ..... 315/39.51; 361/302; 219/761

[58] Field of Search ..... 315/39.51; 361/302; 219/761, 715, 716

[56] References Cited

U.S. PATENT DOCUMENTS

| | | | |
|---|---|---|---|
| 3,789,263 | 1/1974 | Fritz et al. | 315/39.51 |
| 4,100,463 | 7/1978 | Sugie | 219/761 X |
| 4,300,072 | 11/1981 | Tashiro | 315/39.51 |
| 4,383,156 | 5/1983 | Furusawa | 219/715 |
| 4,752,720 | 6/1988 | Oguro et al. | 315/39.51 |
| 4,814,938 | 3/1989 | Arakawa et al. | 361/302 |
| 4,851,629 | 7/1989 | Bessyo et al. | 219/761 |
| 4,853,824 | 8/1989 | Tsuzurahara | 361/302 |
| 4,858,064 | 8/1989 | Segawa et al. | 333/182 X |
| 4,900,985 | 2/1990 | Tashino et al. | 315/39.51 |
| 5,040,091 | 8/1991 | Yamaoka et al. | 361/302 |
| 5,432,405 | 7/1995 | Ochiai et al. | 315/39.51 |

FOREIGN PATENT DOCUMENTS

| | | | |
|---|---|---|---|
| 57-25713 | 2/1982 | Japan | 333/182 |
| 57-56504 | 4/1982 | Japan . | |
| 2056889 | 2/1990 | Japan | 219/715 |

*Primary Examiner*—Benny T. Lee
*Assistant Examiner*—Justin P. Bettendorf
*Attorney, Agent, or Firm*—Antonelli, Terry, Stout & Kraus, LLP

[57] ABSTRACT

A magnetron provided with a filter circuit for suppressing leaking of the electromagnetic wave of the magnetron. First and second choke coils have their respective first ends serially connected to two externally protruding leads for supporting a cathode filament of the magnetron. A feed-through capacitor is parallelly connected to the second ends of the first and second choke coils respectively. The feed-through capacitor is constituted by a dielectric ceramic material having a relative dielectric constant $\epsilon_s$ which satisfies $\sqrt{\epsilon_s} \leqq 50$, whereby sound pressure produced by of the feed-through capacitor is reduced without increasing the size of the feed-through capacitor and while keeping the necessary breakdown voltage characteristic and necessary electrostatic capacity.

5 Claims, 10 Drawing Sheets

MICROWAVE OVEN

MAGNETRON WITH FEED-THROUGH CAPACITOR HAVING A DIELECTRIC CONSTANT EFFECTING A DECREASE IN ACOUSTIC NOISE

BACKGROUND OF THE INVENTION

The present invention relates to a magnetron used in microwave application apparatus, and particularly relates to a magnetron in which the intensity of vibratory noise, that is, sound pressure, due to electro-striction in the material of a feed-through capacitor which constitutes a filter circuit of the magnetron is suppressed.

Because of their high efficiency in generating high frequency output, magnetrons are applied widely in the fields of radars, medical appliances, microwave ovens, and other microwave application apparatus.

Such a magnetron of this type is provided with a body portion having a resonance cavity, high frequency output portion and so on, and a filter portion for suppressing leakage of electromagnetic waves in a power supply portion for supplying the body portion with electric power.

The filter circuit is constituted by two choke coils and a feed-through capacitor. The choke coils are connected in series, at their respective first ends, to two externally led-out leads for supporting a filament provided in the resonance cavity and for supplying the filament with electric power. The feed-through capacitor is connected in parallel to the respective second ends of the choke coils.

The feed-through capacitor is passed through the wall of a filter casing in which the filter circuit is received from the inside to the outside so as to be connected to an external power supply.

As literature disclosing a conventional technique relating to a feed-through capacitor of this type which uses a commercial power source, refer to Japanese Utility Model Publication No. 57-56504.

The feed-through capacitor constituting the filter circuit provided in the magnetron uses a high dielectric constant ceramic material as its material. An alternating high voltage of several $kV_{p-p}$ having a frequency in a range of from 20 to 1,000 Hz is applied across the opposite terminals of the feed-through capacitor in operation of the magnetron.

In the commercial power source driving method, therefore, the ceramic constituting the feed-through capacitor is vibrated by electrostriction so as to produce sound waves of high sound pressure. The sound waves are radiated as unpleasant scoustic noise.

In order to reduce production of such electro-striction, use has been considered of a material of small dielectric constant e as the material constituting the feed-through capacitor. In the case of using such a small dielectric constant, the electrostatic capacity becomes small. In order to secure sufficient electro-static capacity necessary for the filter circuit for suppressing leakage of electric waves, it is necessary to reduce the distance between the electrodes of the feed-through capacitor or to increase the electrode area.

If the inter-electrode distance is made small, however, the breakdown voltage characteristic is lowered, while if the electrode area is increased, the size of the feed-through capacitor per se becomes large preventing miniaturization of the magnetron assembly.

SUMMARY OF THE INVENTION

It is an object of the present invention to provide a magnetron in which the sound pressure of the sound wave produced from the material of a feed-through capacitor constituting a filter circuit is reduced without increasing the size of the feed-through capacitor and while keeping necessary breakdown voltage characteristic.

In order to achieve the above object, according to an aspect of the present invention, in a magnetron provided with a filter circuit which is constituted by two choke coils connected in series, at their respective first ends, to two protruing leads for supporting a filament, and a feed-through capacitor connected in parallel to the respective second ends of the choke coils, the feed-through capacitor is constituted by a dielectric ceramic material having a relative dielectric constant $\epsilon_s$ which the requirement $\sqrt{\epsilon_s} \leqq 50$.

According to another aspect of the present invention, in the above configuration of the capacitor, the electrostatic capacity C of the dielectric ceramic material is set to be in a range of from 100 to 300 pF.

According to a further aspect of the present invention, in a magnetron provided with a filter circuit which is constituted by two choke coils connected in series, at their respective first ends, to two protruding leads for supporting a filament, and a feed-through capacitor connected in parallel to the respective second ends of the choke coils, the feed-through capacitor is constituted by a dielectric porcelain material having a relative dielectric constant $\epsilon_s$ which satisfies the requirement $\sqrt{\epsilon_s} \leqq 50$, the electrostatic capacity C of the dielectric ceramic material is set to be in a range of from 100 to 300 pF, and the inductance L of the choke coils is set to be nearly equal to 1 μH.

As the above-mentioned dielectric porcelain material having a relative dielectric constant $\epsilon_s$ which satisfies the $\sqrt{\epsilon_s} \leqq 50$, for example, a $SrTiO_3$ system material ($\sqrt{\epsilon_s} \sim 42$) may be used.

By forming the configuration in such a manner as mentioned above, according to the present invention, it is possible to provide a magnetron in which the sound pressure of the sound wave produced from the material of a feed-through capacitor constituting a filter circuit is reduced without increasing the size of the feed-through capacitor while keeping the necessary breakdown voltage characteristic and the necessary electrostatic capacity and which is therefore suitable to home appliances.

That is, a feed-through capacitor being formed of a dielectric ceramic material and constituting an LC filter for suppressing noise wave leaking from a cathode terminal of a magnetron of this type is connected, at its central feed-through portion, between a high voltage side cathode terminal or lead and the grounding side cathode terminal or lead. The high voltage side cathode terminal and a grounding side cathode terminal are isolated from each other with insulating resin.

In operation of the magnetron, the dielectric porcelain material constituting the feed-through capacitor produces sound because of electrostriction of the dielectric ceramic material per se because a high voltage, for example, $4kV_{p-p}$, of a commercial frequency in a range of from 20 to 1,000 Hz is applied to the feed-through capacitor. That is, when an electric field is applied to a dielectric ceramic material, dielectric polarization is caused in the dielectric porcelain material so that acoustic noise offensive to the ear is generated by mechanical distortion/vibration. It is known that the sound pressure is proportional to the square of the applied electric field intensity.

On the other hand, in the case where the electric field intensity is constant, the sound pressure is expressed as follows:

$$S \propto \frac{K_p}{2f_r D} \sqrt{(\epsilon_o \cdot \epsilon_s)/P}$$

where

S: sound pressure $K_p$: electro-mechanical coupling factor $f_r$: resonant frequency D: diameter of dielectric ceramic $\epsilon_o$: dielectric constant of vacuum $\epsilon_s$: relative dielectric constant of dielectric ceramic P: density of dielectric ceramic It can be understood that the sound pressure is proportional to a square root of the relative dielectric constant $\epsilon_s$ of the dielectric ceramic. That is, one way to reduce the sound pressure due to the electro-striction to a low value is to employ a dielectric material having a small relative dielectric constant $\epsilon_s$.

On the other hand, if the relative dielectric capacity is made small, the electrostatic constant of the feed-through capacitor becomes small. In order to correct this, it is necessary to make the size of the dielectric ceramic small, specifically, make the distance between the electrodes of the dielectric porcelain small, or it is necessary to make the size of the material large so as to make the electrode area large.

According to the present invention, by the configuration as mentioned above as the aspects of the invention, it is possible to provide a magnetron in which the sound pressure of the noise sound wave produced from the material of the feed-through capacitor is reduced without increasing the size of the feed-through capacitor constituting the filter circuit, and, hence, without increasing the size of the magnetron assembly, while keeping the necessary breakdown voltage characteristic and necessary electrostatic capacity.

DESCRIPTION OF THE PREFERRED EMBODIMENTS

Referring to the accompanying drawings, embodiments of the present invention will be described below in detail.

Figure 1:
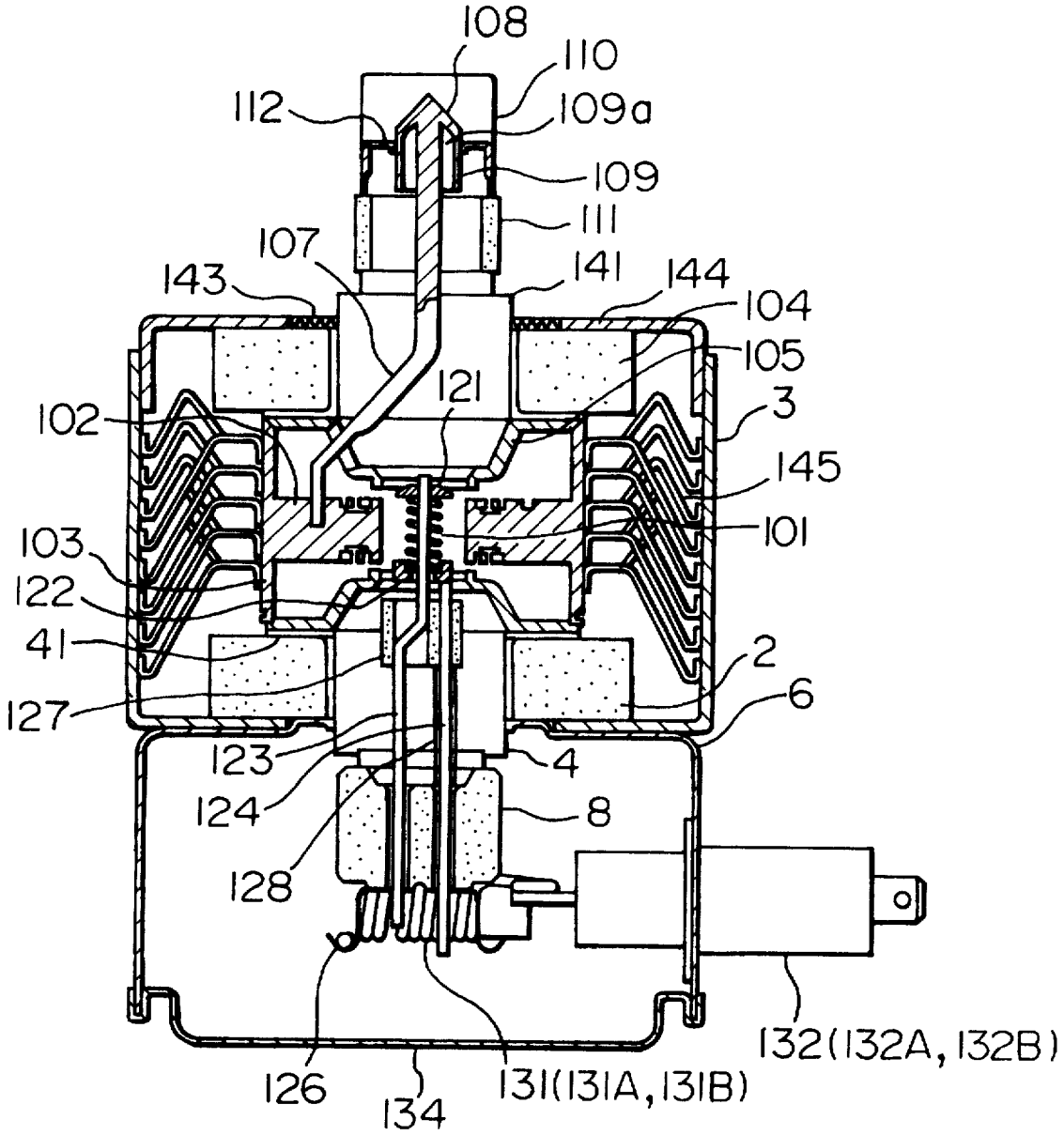
FIG. 1. is a sectional view for explaining an structural example of an embodiment of the magnetron according to the present invention.

FIG. 1 is a sectional view for explaining the structure of an embodiment of the magnetron according to the present invention. In the drawing, the magnetron is constituted by a lower magnet 2; a lower yoke 3; a lower seal member 4; a collar-like seal material 41 of the lower seal member 4; a filter casing 6; an input-side ceramic 8; a cathode filament 101; a plurality of anode veins 102; an anode cylinder 103; an upper magnet 104; a pole piece 105; an antenna lead 107; an antenna 108; an exhaust pipe 109; an antenna cover 110; a cylindrical insulator 111; an exhaust pipe support 112; an upper end shield 121; a lower end shield 122; a cathode lead 123; another cathode lead 124; a cathode terminal 126; a spacer 127; a sleeve 128; a choke coil 131; a feed-through capacitor 132; a cover 134; an upper seal member 141; a metal gasket 143; an upper yoke 144; and a plurality of cooling fins 145.

In FIG. 1, the plurality of anode veins 102 are formed radially around the cathode filament 101. The plurality of anode veins 102 are fixed to the anode cylinder 103 by soldering or the like, or by being integrally formed together with the anode cylinder 103 through extrusion molding or the like.

The cylindrical upper magnet 104 and the cylindrical lower magnet 2 are provided on the upper and lower portions of the anode cylinder 103 respectively. The magnetic flux from the upper magnet 104 and lower magnet 2 generates, through the pole piece 105, a necessary DC magnetic field in the up/down direction (in the direction of the tube axis) in an operation space formed between the cathode filament 101 and the anode veins 102. The lower yoke 3 and the upper yoke 144 are provided to make the magnetic flux from the magnetron pass therethrough.

The cathode filament 101 is at a negatively high potential, for example, a peak-to-peak voltage of 4 $kV_{p\text{-}p}$. That is, the cathode filament 101 is connected to the choke coil 131 through the two cathode leads 123 and 124. Further, one terminal of the choke coil 131 is connected to one terminal of the feed-through capacitor 132, and the other terminal of the feed-through capacitor 132 is connected to a filament transformer (which will be described later) which is kept at a negatively high potential. For example, an alternating high voltage 4 $kV_{p\text{-}p}$ having a frequency in a range of from 20 to 1,000 Hz is applied across the feed-through capacitor 132.

As the material of the feed-through capacitor 132, a dielectric ceramic is used. As the dielectric ceramic material, according to the present invention, the material mentioned above as the aspect of the present invention is substituted for conventionally used $BaTiO_3$ system material ($\sqrt{\epsilon_s}$~70, electrostatic capacity C=500 pF), so that the electrostriction can be suppressed without lowering the characteristic of the LC filter.

In such a structure, the electrons emitted from the cathode filament 101 are influenced by the DC magnetic field so as to form a high frequency potential on the respective anode veins 102 while conducting a circular motion to thereby generate a high frequency wave or microwave. The thus generated microwave is radiated from the antenna 108 through the antenna lead 107.

Figure 2:
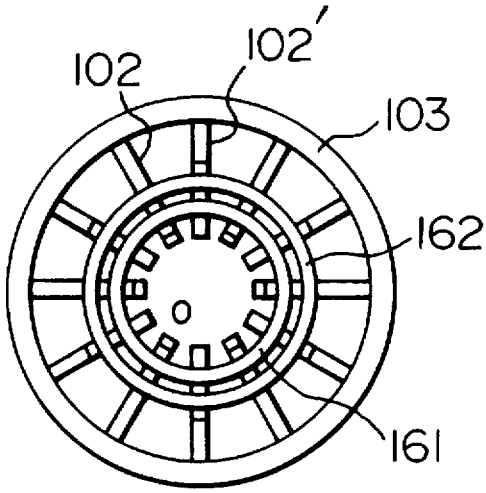
FIG. 2. is a plan view for explaining the details of the anode portion of the magnetron.

FIG. 2 is a plan view for explaining the details of the anode portion of the magnetron shown in FIG. 1. The anode veins 102 and 102' are provided from the inner wall of the anode cylinder 103 toward the center O. In other words, the anode veins 102 and 102' are arranged radially when viewed from the axis line passing the center O.

The anode veins 102 and 102' are alternately connected through a first strap ring 161 and a second strap ring 162, each of which is constituted by two annular bodies, the annular bodies of the first strap ring 161 being different in diameter from the annular bodies of the second strap ring 162.

Figure 3:
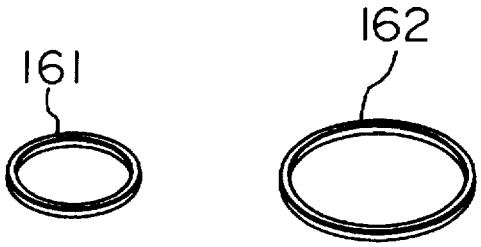
FIG. 3 is a perspective view for explaining the strap ring of the magnetron.
Figure 4:
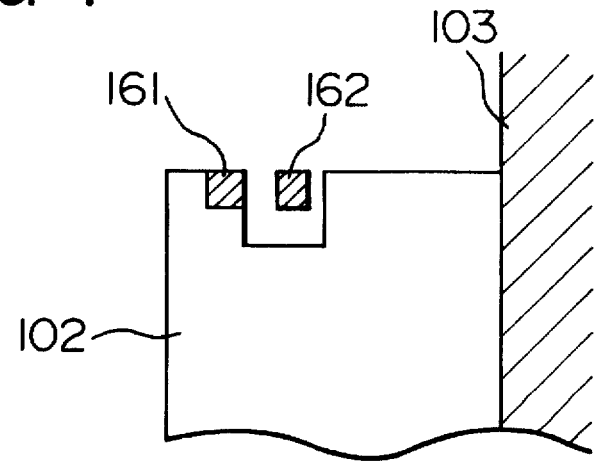
FIG. 4 is a fragmentary sectional view for explaining the anode vein portion of the magnetron.

FIG. 3 is a perspective view for explaining the strap rings of FIG. 2. The first strap ring 161 is smaller in diameter than the second strap ring 162;

FIG. 4 is a main part explanatory view of the anode vein portion of the magnetron shown in FIG. 1. The above-mentioned small-sized, first strap ring 161 contacts with the illustrated anode vein 102 while the above-mentioned large-sized, second strap ring 162 does not contact with the illustrated anode veins 102. On the other hand, the small-sized, first strap ring 161 does not contact with the anode veins 102' adjacent to the illustrated anode vein 102 while the large-sized, second strap ring 162 contacts with the anode vein 102' adjacent to the illustrated anode vein 102. The plurality of anode veins 102' and the first and second strap rings 161 and 162 are arranged in such a manner as mentioned above so that the first strap ring 161 and the second strap ring 162 are joined to alternate ones of the plurality of anode veins 102'.

Further, as shown in FIG. 2, the antenna lead 107 for leading out the microwave energy is planted by soldering to one of the anode veins 102 or 102'.

The antenna lead 107 planted to the anode vein 102 or 102' passes through the pole piece 105 sealed on one end of the anode cylinder 103. The cylindrical insulator 111 is air-tightly sealed at its one end to the end portion of the upper seal member 141 which is a metal sealing member. The cup-like exhaust pipe support 112 soldered to the outer periphery of the exhaust pipe 109 is soldered to the other end portion of the cylindrical insulator 111.

After the inside of tube of the magnetron has been evacuated to a vacuum, the exhaust pipe 109 is sealed off together with the antenna lead 107, and then the antenna cover 110 is pressed onto the exhaust pipe support 112 and fixed thereto so as to protect the top of the exhaust pipe support 112. A recess portion **109*a* formed by sealing off the exhaust pipe 109 and the antenna lead 107** functions as a choke portion for checking radiation of unnecessary electric waves.

As the material of the cathode filament 101 for producing electrons, generally, tungsten containing a very small amount of thorium oxide ($ThO_2$) is used. In order to improve the electron emission characteristic, a carbide layer ($W_2C$) is formed on the surface of the cathode.

The cathode filament 101 is engaged with and supported by the upper end shield 121 and lower end shield 122 through a high melting point brazing material such as a ruthenium-molybdenum eutectic alloy or the like.

The upper end shield 121 and the lower end shield 122 are supported by the cathode leads 123 and 124 respectively. Molybdenum (Mo) is generally used as a material for those end shields 121 and 122 and cathode leads 123 and 124 in the point of view of heat resistance and workability.

Getter is deposited on the upper surface of the upper end shield 121 so that the getter material is evaporated at the time of heating of the cathode filament 101 to maintain the degree of vacuum in the oscillation space to keep a stable operation characteristic for a long period.

The two cathode leads 123 and 124 are supported by the input-side ceramic 8, and they are soldered to the input-side ceramic 8 together with cathode terminal 126 so as to keep the vacuum and airtightness.

If mechanical shocks or vibrations are applied to the magnetron, the cathode leads 123 and 124 vibrate to cause mechanical stress in the cathode filament 101 because the cathode leads 123 and 124 are different in the manner of vibration from each other. Consequently, in some cases, breaking of the cathode 101 is caused. In order to prevent such breaking from occurring, the spacer 127 is used. Owing to the function of this spacer 127, even if the cathode leads 123 and 124 vibrate, the respective motions of the cathode leads 123 and 124 due to the vibrations are substantially identical with each other so that the stress applied to the cathode 101 can be made small. The sleeve 128 is provided for supporting the spacer 127 at a predetermined position.

The cathode terminal 126 is connected to the choke coil 131, the choke coil 131 is connected to the feed-through capacitor 132 attached to the filter casing 6 of the input portion, and the feed-through capacitor 132 is connected to the power source. Generally, the connection between the cathode terminal 126 and the choke coil 131 is carried out by welding. Further, also the connection between the choke coil 131 and the feed-through capacitor 132 is generally carried out by welding.

The choke coil 131 and the feed-through capacitor 132 constitute a low pass filter when the power source side is viewed from the inside of the magnetron. This is for prevention of the microwave generated in the operation space between the cathode filament 101 and the anode cylinder 103 from radiating to the outside through the cathode filament 101 and the cathode leads 123 and 124.

Figure 5:
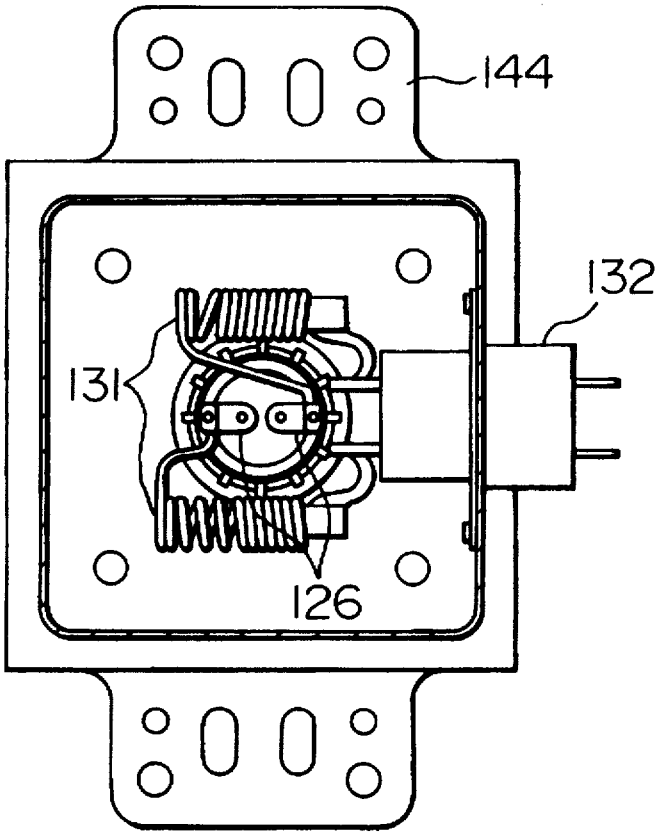
FIG. 5 is a plan view of the filter casing portion when the input portion of the magnetron is viewed from the under side.

FIG. 5 is a plan view of the filter casing portion when the input portion of the magnetron shown in FIG. 1 is viewed from the under side. The cathode terminal 126 is connected to the choke coil 131, the choke coil 131 is connected to the feed-through capacitor 132 attached to the filter casing 6 of the input portion, and the feed-through capacitor 132 is connected to the power source which is not shown in the drawing.

Figure 6:
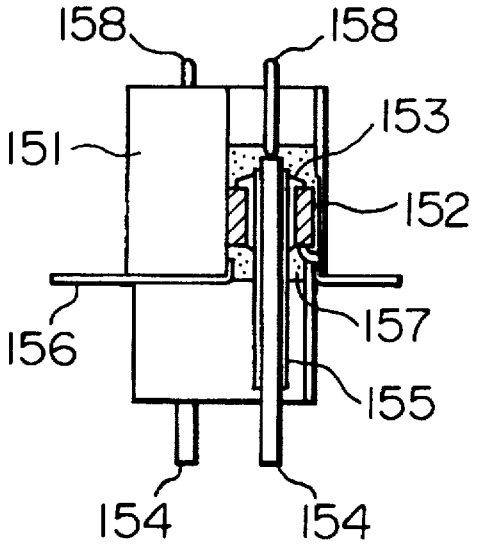
FIG. 6 is a main portion sectional view for explainig the structure of the feed-through capacitor of the magnetron.

FIG. 6 is a main portion sectional view for explaining the structure of the feed-through capacitor. In the drawing, a reference numeral 151 designates an insulating cover, 152 designates a dielectric, and 153 and 156 designate electrodes.

In FIG. 6, the dielectric 152 constitutes a capacitor 132 in cooperation with the electrodes 153 and 156. The electrode 156 further functions to attach the feed-through capacitor 132 to the filter casing 6. Although the electrode 153 is shown so as to be separated from a terminal 154 in the left lower portion of FIG. 6, it is connected integrally to the terminal 154 in the other section.

Further, the reference numeral 155 designates a silicon tube which covers the terminal 154 to insulate the terminal 154 from the electrode 156, and which also functions as a damper to prevent close contact between resin 157 and the dielectric 152. The reference numeral 151a is a stopper which has a function to break the stress produced in the resin 157 to thereby prevent the resin from moving. The terminal 154 is connected to one end of the choke coil 131, and is grounded through feed-through capacitor (132A, 132C).

In this embodiment, as a dielectric porcelain material for forming the dielectric 152, a high dielectric constant material of $SrTiO_3$ system ($\sqrt{\epsilon_s}$~42) is used. In comparison with the conventional dielectric porcelain material ($BarTiO_3$ system of $\sqrt{\epsilon_s}$~70), although the dielectric porcelain material of this embodiment does not cause lowering of the breakdown voltage characteristic and increase of the size of the capacitor because the size of the dielectric ceramic material of this embodiment is the same as that of the conventional one, the electrostatic capacity C takes a value in a range of from 180 to 300 pF in the case of the material of $SrTiO_3$ system while it takes 500 pF in the case of the material of system $BaTiO_3$.

On the other hand, the choke coil 131 constituting the LC filter has inductance L of 1 μH.

As shown in FIG. 1, the cathode leads 123 and 124 are connected in series to the respective one ends of choke coils 131A and 13lB, and the respective other ends of choke coils 131A and 131B, are grounded through capacitors 132A and 132C.

The filter casing 6 of the input portion is closed by means of the cover 134 so that the high frequency wave or microwave is prevented from being radiated to the outside.

The input-side ceramic 8 is engaged in an airtight manner with the anode cylinder 103 through the lower seal member 4 having the collar-like seal material 41 so as to keep the vacuum, and the cylindrical insulator 111 is engaged in an airtight manner with the anode cylinder 103 through the upper seal member 141 so as to keep the vacuum.

The upper yoke 144 is electrically connected to the upper seal member 141 through the metal gasket 143. This upper seal member 141 is at the same potential as the anode cylinder 103, and hence the upper yoke 144 is at the same potential as the anode cylinder 103.

Figure 7:
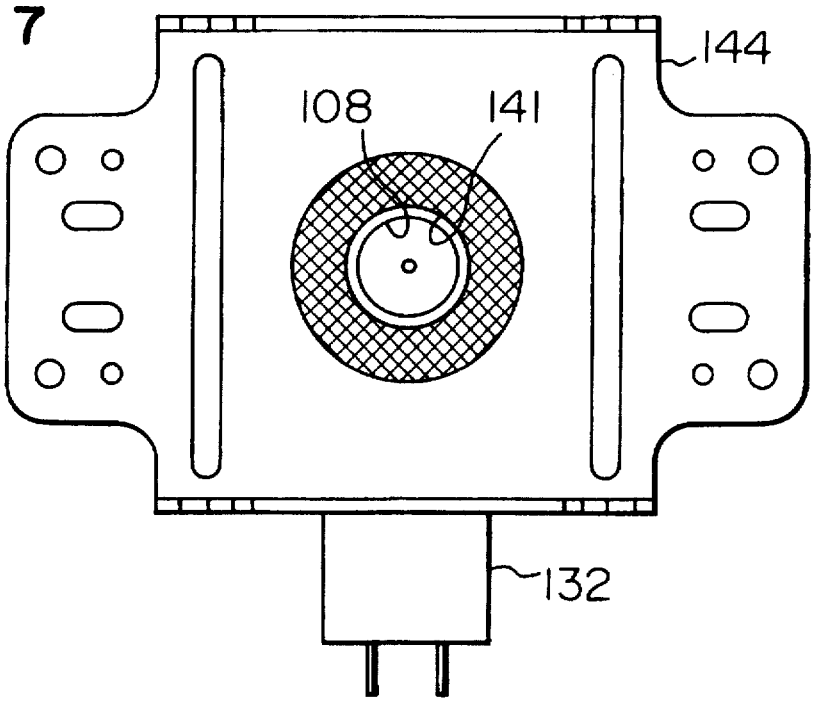
FIG. 7 is a top view of the magnetron.

FIG. 7 is a top view of the magnetron in which, generally, the upper yoke 144 and the lower yoke 3 (FIG. 1) are connected through caulking.

Figure 8:
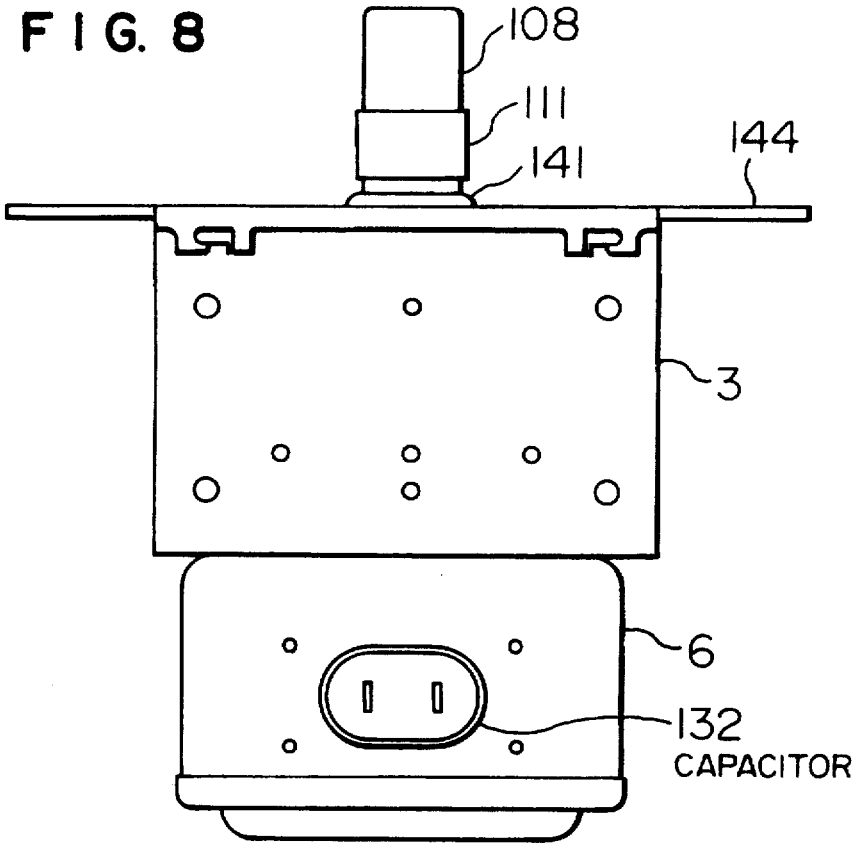
FIG. 8 is a side view showing the appearance of the magnetron when viewed from the yoke side.

FIG. 8 is a side view showing appearance of the magnetron when viewed from the yoke side. The antenna 108 is connected, through the cylindrical insulator 111 and through the upper seal member 141 which passes through the upper yoke 144, to the antenna lead which has been described above with respect to FIG. 1. The filter casing 6 is fixedly connected to the under portion of the lower yoke 3 in such a manner as described above. The reference numeral 132 is the feed-through capacitor.

Figure 9:
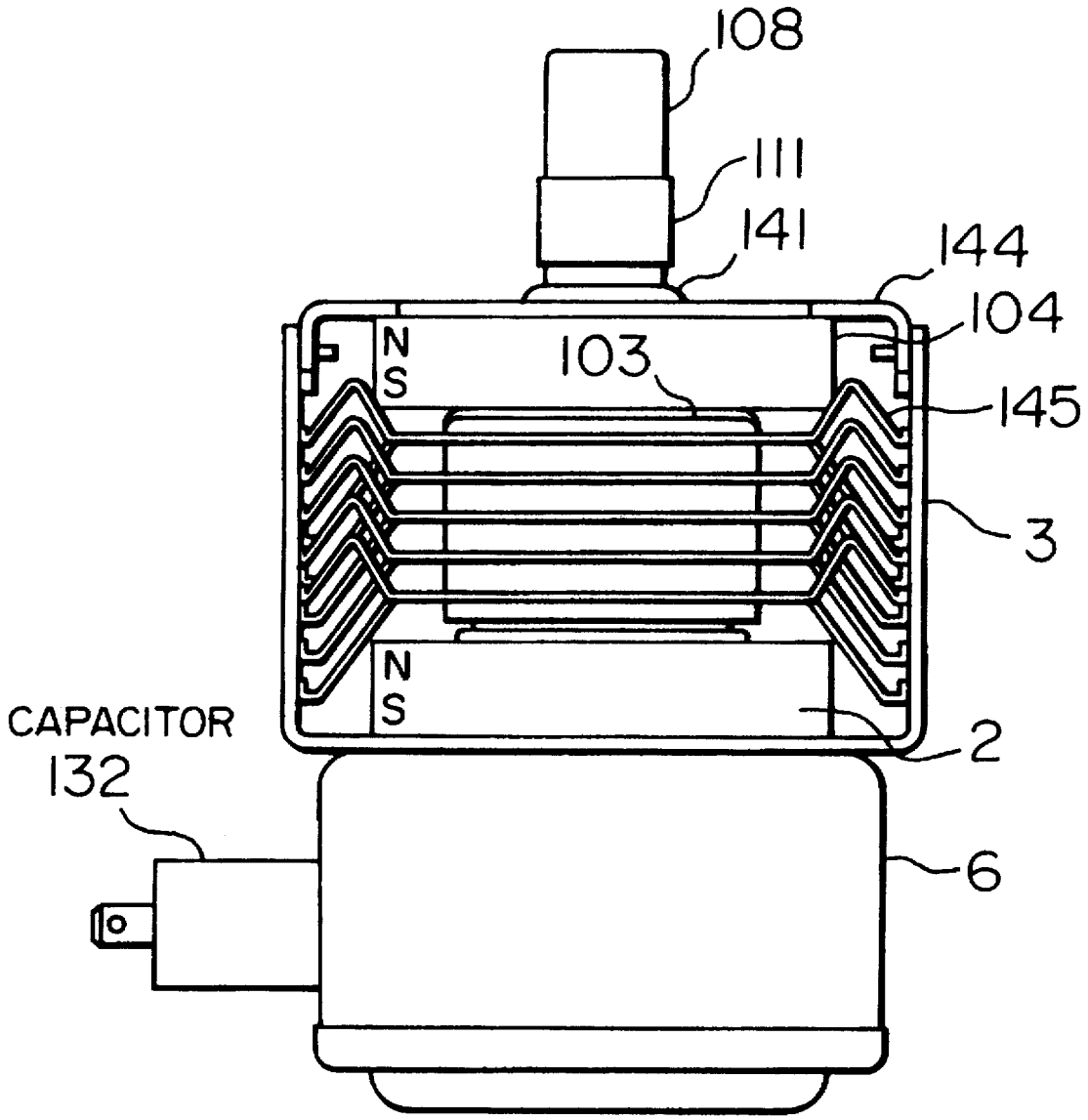
FIG. 9 is an explanatory view of the cooling fins of the magnetron.

FIG. 9 is a front view for explaining the appearance of the magnetron when viewed from the cooling fin side.

The temperature of the anode of the magnetron becomes high by heat radiation from the cathode filament 101 or by heat generation due to collision of electrons from the cathode filament 101 against the anode vein 102, as described above with respect to FIG. 1. The high temperature of the anode makes the magnetic characteristic of the magnet change, adversely affecting the peripheral devices of the magnetron, and so on. The cooling fins 145 are provided for dissipating the heat thus generated.

Figure 10A:
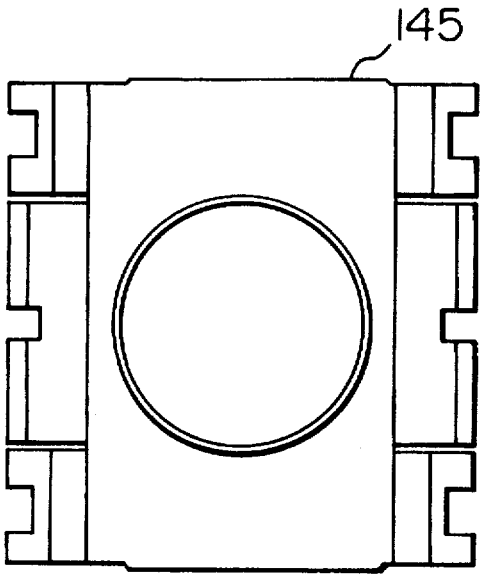
FIGS. 10A–10C are explanatory views of the shape of the cooling fins of the magnetron.
Figure 10C:
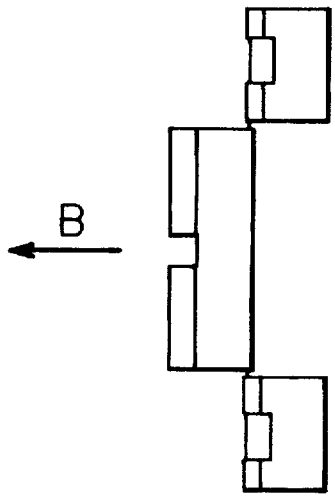
Figure 10C:
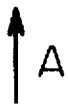
Figure 10B:
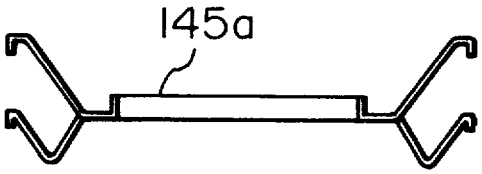

FIGS. 10A–10C are explanatory views of the shape of the cooling fins 145, in which FIG. 10A is a plan view, FIG. 10B is a side view when viewed in the direction of arrow A in FIG. 10A, and FIG. 10C is a side view when viewed in the direction of arrow B in FIG. 10A.

In FIGS. 10A–10C, a cylindrical portion 145*a* is fitted to the anode cylinder 103 of FIG. 9. In FIG. 9, five cooling fins of the type shown in FIGS. 10A–10C are provided.

At the time of operation of the magnetron, generally, cool air is sent to the cooling fins by means of a cooling fan provided in an application apparatus such as a microwave oven or the like.

Figure 11A:
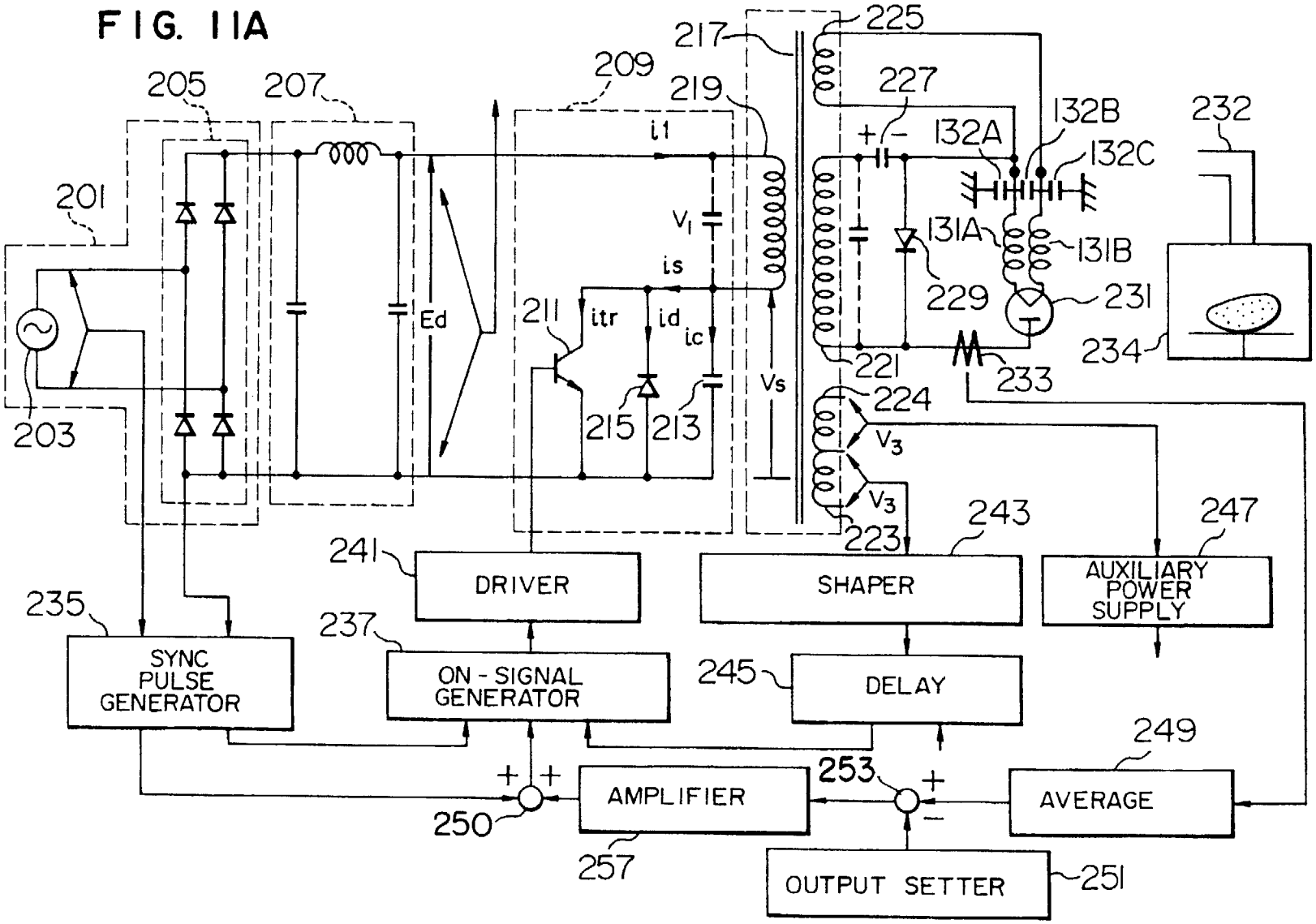
FIG. 11A is a circuit diagram for explaining an example of the driving circuit of the magnetron.

FIG. 11A is a circuit diagram for explaining an example of the driving circuit of the magnetron. In the drawing, the reference numeral 231 designates the magnetron.

A DC power source 201 for supplying DC power to a switching power supply 209 is constituted by a commercial AC power source 203 and a full-wave rectifier 205.

A filter 207 constituted by a reactor and capacitors is connected to a DC output terminal of the full-wave rectifier 205, but this filter 207 functions so as not to smooth the rectified current, but to prevent high frequency noise contained in the oscillation current from leaking out through an AC power source side.

The switching power supply 209 is provided with a transistor 211 which is made to perform on-off operation by a driving circuit 241 which is driven by an ON-signal of an ON-signal generator 237 controlled by a synchronizing pulse which is generated by a synchronizing pulse generator 235.

The switching power supply 209 is provided with a damper diode 215 which is reverse-parallelly connected to the transistor 211 and a resonance capacitor 213 which is connector parallelly also to the transistor 211.

The switching power supply 209 is connected to a boosting transformer 217 having a primary winding 219 and secondary windings 221, 223, 224 and 225. The primary winding 219 is connected to the filter 207 through the switching power supply 209, and a series resonance circuit is constituted by the capacitor 213 and the primary winding 219.

The secondary winding 221 is connected to the magnetron 231 through a voltage doubling rectifier constituted by a capacitor 227 and high voltage diode 229. A current detector 233 detects a load current flowing in the magnetron. The detection output of the current detector 233 is averaged by an average circuit 249. The difference between the average value outputted from the average circuit 249 and a setting value of an output setter 251 is obtained by a subtracter 253. The difference is supplied, through an amplifier 257, to an adder 250 so as to be added to the synchronizing pulse from the synchronizing pulse generator 235, and an output of the adder 250 is supplied, as a control signal, to the ON-signal generator 237.

The secondary winding 225 is provided for heating the filament of the magnetron 231. The further secondary winding 223 is provided for producing a voltage for output feedback. The output feedback voltage is delayed by a predetermined time by means of a delay circuit 245 after being shaped by a waveform shaping circuit 243, and then is supplied as a control signal to the ON-signal generator 237.

The output of the secondary winding 224 is supplied to an auxiliary power supply 247 so as to be used, after being rectified, as a power source for a control circuit and so on.

Generally, a high voltage of several Kv is applied across the filament and the anode.

In FIG. 11A, the reference numeral 232 designates a waveguide, and 234 designates a cooking chamber of a microwave oven which is supplied with microwave energy generated by the magnetron 231 through the waveguide 232.

Figure 11B:
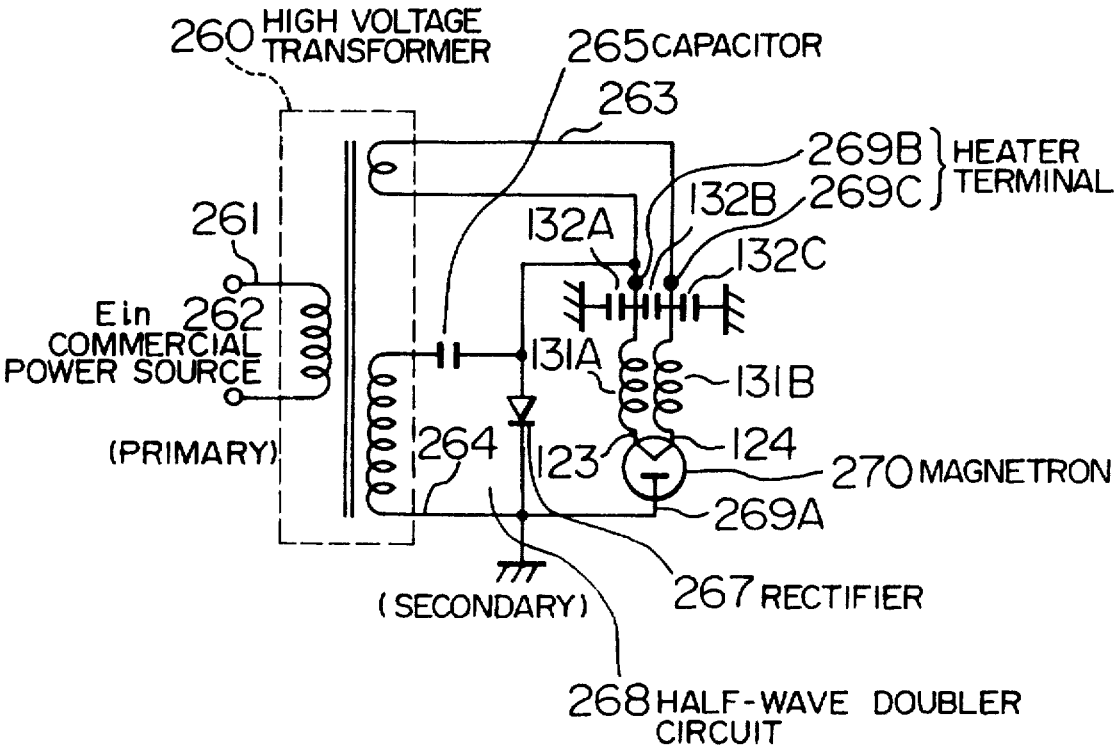
FIG. 11B is a view showing, by way of example, a magnetron driving circuit by means of a commercial power source.

FIG. 11B is a view showing an example of a commercial power source magnetron driving circuit generally employed for use for home microwave oven. In the drawing, a primary winding 261 of a high voltage transformer 260 is connected to a commercial power source 262. A half-wave doubler circuit 268 is constituted by a capacitor 265 and a rectifier 267 at one end of a secondary winding 264. The half-wave doubler circuit 268 is connected to one heater terminal 269B of a magnetron 270, and the other end of the secondary winding 264 is connected to anode terminal 269A of magnetron 270 to apply a negative anode voltage. A predetermined voltage is applied, from a secondary winding 263, across filament heater terminals 269B and 269C.

Respective one ends of two choke coils 131A and 131B are connected to externally led-out leads 123 and 124 for supporting the cathode filament. A series connection of feed-through capacitors 132A, 132B and 132C is parallelly connected to the respective other ends of the choke coils 131A and 131B. Respective first ends of the feed-through capacitors 132A and 132C are grounded. The opposite ends of the feed-through capacitor 132B, and the respective second ends of the feed-through capacitors 132A and 132C are connected to the heater terminals 269B and 269C. The feed-through capacitors 132A, 132B and 132C are constituted to be a rod-like structured component 132 which is connected to the heater terminals through the leads 154 and 158, as previously shown in FIG. 6. Thus, the filter circuit according to the present invention is constituted.

Also here, an alternating high voltage, for example, several $kV_{p\text{-}p}$ in a range of from 20 to 1,000 Hz, is applied to the opposite ends of the feed-through capacitor.

Figure 12:
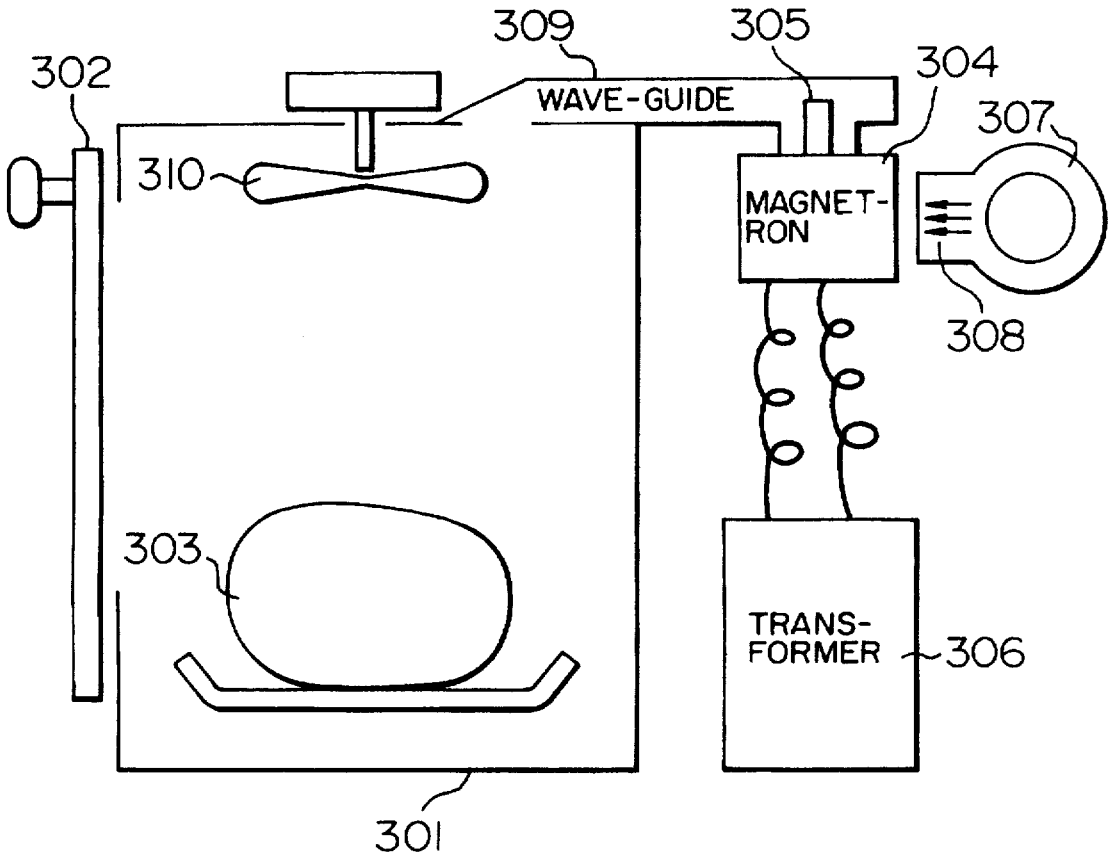
FIG. 12 is a diagrammatic view for explaining a specific example in which the magnetron according to the present invention is applied to a microwave oven.

FIG. 12 is a conceptual view for explaining a specific example in which the above-mentioned embodiment of the magnetron according to the present invention is applied to a microwave oven. In FIG. 12, the microwave oven has a cooking chamber 301 into which a subject to be heated 303 is set through a door 302. The reference numeral 304 designates a magnetron; 305, an antenna; 306, a power supply for the magnetron; 307, a cooling fan; 308, cooling air; 309, a waveguide; and 310, a stirrer.

In FIG. 12, microwave energy generated by the magnetron 304 is supplied, from the antenna 305 and through the waveguide 309, to the cooking chamber 301 in which the subject to be heated 303 is set. The stirrer 310 is provided so as to rotate in the cooking chamber 301 to diffuse the microwave energy so that the subject to be heated 303 is heated uniformly.

The cooling fan 307 is provided to send the cooling air 308 to the magnetron 304 to thereby cool the magnetron 304.

The feed-through capacitor in the above embodiment according to the present invention uses $SrTiO_3$ system material of $\sqrt{\epsilon_s}$~42 so that the sound pressure of the feed-through capacitor is 24 dB in the driving test by use of 50 Hz commercial power source, while that of the conventional feed-through capacitor which uses $BaTiO_3$ system material is 40 dB. Thus, the sound pressure is reduced to about 60% of the conventional feed-through capacitor. The sound pressure of 24 dB is not so offensive to the ear for a user.

Figure 13:
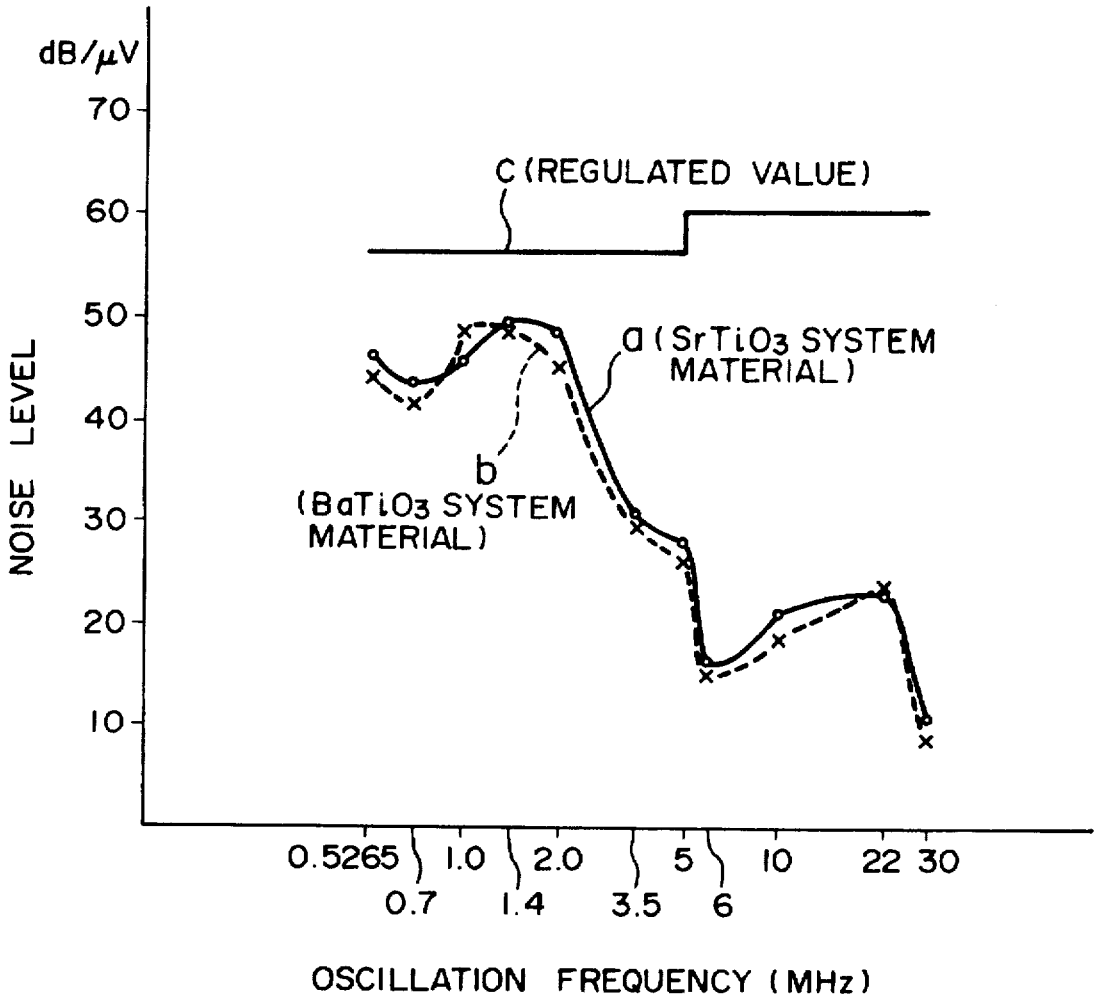
FIG. 13 is a characteristic diagram showing the results of measurement of noise level of the magnetron using a feed-through capacitor according to the present invention in comparison with the conventional magnetron.

FIG. 13 is a characteristic diagram showing the results of measurement of terminal noise level of the magnetron using the feed-through capacitor according to the present invention in comparison with the conventional magnetron.

In FIG. 13, the characteristic plot curve (a) shows the noise level of the feed-through capacitor of the above embodiments, the characteristic curve (b) shows the noise level of the feed-through capacitor using the conventional $BaTiO_3$, and the characteristic curve (c) shows the regulated value in accordance with the electrical supplies regulatory law in Japan.

As shown in FIG. 13, it is understood that even if the electrostatic capacity C decreases to 180–300 pF from the conventional value of 500 pF by using the $SrTiO_3$ material according to the present invention, the characteristic is such that the leakage of electric wave in the frequency band of from 0.5 to 30 MHz is small and the noise level (a) is substantially equal to the conventional noise level (b). The capacitance C of the feed-through capacitor smaller than 100 pF is found practically not effective from a viewpoint of terminal noise level.

Thus, according to the above embodiments, it is possible to obtain a magnetron in which various problems in the conventional technique are solved and which has high reliability.

The present invention is not limited to those structures described in the above embodiments, but it is a matter of course that various modifications may be made by selecting proper relative dielectric constant $\epsilon_s$ so as to suppress the noise due to electrostrictive stress without deteriorating the leakage wave blocking characteristic of the LC filter, and without departing from the technical thought of the present invention.

As described above, according to the present invention, by use of dielectric ceramic material of relative dielectric constant $\sqrt{\epsilon_s} \leqq 50$ as a dielectric material for the feed-through capacitor and by making the inductance constituting the LC filter be L~1 μH, the level of the noises due to electrostrictive stress generated from the feed-through capacitor of the magnetron can be reduced without deteriorating the required filter characteristic.

What is claimed is:

1. A magnetron device provided with a filter circuit comprising:

first and second choke coils, each choke coil having a first end and a second end, each first end connected to a respective externally protruding lead for supporting a filament of the magnetron device;

a feed-through capacitor connecting second ends of said first and second choke coils, said feed-throuqh capacitor being constructed of a dielectric ceramic material having a relative dielectric constant $\epsilon$, which satisfies $\sqrt{\epsilon_s} \leqq 50$, to reduce sound pressure of an acoustic wave produced by said dielectric ceramic material without increasing the size of said feed-through capacitor, said magnetron device being of the magnetron drive power source type for driving by an alternating high voltage of several KV peak-to-peak and in the frequency range of from 20 to 1,000 Hz applied across terminals of said feed-through capacitor.

2. A magnetron circuit according to claim 1, wherein said feed-through capacitor has an electrostatic capacity C in the range of from 100 to 300 pF.

3. A magnetron device provided with a filter circuit comprising first and second choke coils, each choke coil having a first end connected to a respective externally protruding lead for supporting a filament, and a feed-through capacitor, connecting second ends of said first and second choke coils, said feed-through capacitor being constituted of a dielectric ceramic material have a relative dielectric constant $\epsilon_s$ which satisfies $\sqrt{\epsilon_s} \leqq 50$ and having an electrostatic capacity C in the range of from 100 to 300 pF, and each of said choke coils having an inductance L substantially equal to 1 μH, to reduce sound pressure of an acoustic wave produced by said dielectric ceramic material without increasing the size of said feedthrough capacitor.

4. A magnetron device provided with a filter circuit, for suppressing leaking electromagnetic waves from the magnetron device, comprising first and second choke coils, each choke coil having a first end connected to a respective externally protruding lead for supporting a filament of the magnetron device, and a feed-through capacitor connecting second ends of said first and second choke coils, said magnetron device being of an alternating high voltage application type for driving by a commercial alternating power source, and said feed-through capacitor being constituted of a dielectric ceramic material having a relative dielectric constant $\epsilon_s$ which satisfies the requirement $\sqrt{\epsilon_s} \leqq 50$ and having a capacitance in the range of from 100 pF to 300 pF, to reduce sound pressure of an acoustic wave produced by said dielectric ceramic material without increasing the size of said feed-through capacitor.

5. A magnetron according to claim 4, wherein each of said choke coils has an inductance L substantially equal to 1 μH.

* * * * *